US005303427A

United States Patent [19]

Fishbaine

[11] Patent Number: 5,303,427

[45] Date of Patent: Apr. 19, 1994

[54] COMBINATION HAT AND BAG

[76] Inventor: Dina Fishbaine, 1228 Cambridge St., Apt. 3, Cambridge, Mass. 02139-1316

[21] Appl. No.: 30,821

[22] Filed: Mar. 12, 1993

[51] Int. Cl.[5] ..... A42B 1/00

[52] U.S. Cl. ..... 2/209.11; 2/171; 2/200.1; 383/4

[58] Field of Search ..... 2/192, 194, 195, 196, 2/197, 200, 201, 209.1, 171, 175; 383/4, 75, 105, 107

[56] References Cited

U.S. PATENT DOCUMENTS

| | | | |
|---|---|---|---|
| 1,269,594 | 6/1918 | Geraghty | 2/196 |
| 2,194,043 | 3/1940 | Jacobi | 2/197 |
| 3,011,173 | 12/1961 | Goetz | 2/196 |
| 3,260,292 | 7/1966 | Costello . | |
| 3,275,106 | 9/1966 | Rush . | |
| 3,818,158 | 6/1974 | Nakanishi | 2/209.1 |
| 4,165,542 | 8/1979 | McLaughlin | 2/209.1 |
| 4,472,837 | 9/1984 | Saxton | 2/209.1 |
| 4,575,871 | 3/1986 | Auerbach | 2/209.1 |
| 4,610,038 | 9/1986 | Dennard | 2/209.1 |
| 5,035,006 | 7/1991 | Hetz | 2/209.1 |

FOREIGN PATENT DOCUMENTS

| | | | |
|---|---|---|---|
| 793503 | 9/1968 | Canada | 2/200 |
| 412335 | 7/1910 | France | 2/196 |
| 477209 | 10/1915 | France | 2/196 |
| 1254481 | 1/1961 | France | 2/192 |
| 1134161 | 1/1985 | U.S.S.R. | 2/200 |
| 139436 | 10/1919 | United Kingdom | 2/195 |
| 356358 | 9/1931 | United Kingdom | 2/196 |

*Primary Examiner*—Clifford D. Crowder
*Assistant Examiner*—Diana L. Biefeld
*Attorney, Agent, or Firm*—Wolf, Greenfield & Sacks

[57] ABSTRACT

A hat/bag combination article formed from a tubular member having a closed end and an opposed open end with a drawstring closure. The article can be attractively and inexpensively made from strips of pile fleece to provide a warm and stylized lightweight hat and alternativly as a drawstring bag for holding gloves or other articles and which may be attached to the user's belt loop or wrist.

10 Claims, 2 Drawing Sheets

COMBINATION HAT AND BAG

BACKGROUND OF THE INVENTION

The present invention relates to a combination article which functions as a hat and bag. It is particularly useful as a combination ski hat and bag for ski gloves.

Numerous hat/bag combinations have been proposed but in general, they are unattractive to wear and often difficult and expensive to make.

There is an on going need among winter-sports enthusiasts, such as downhill and cross-country skiers, snowmobilers, and ice skaters, for warm but versatile clothing. Generally, they are covering large distances and do not want to be weighted down carrying extra clothing or equipment. However, as the weather conditions change or their body temperature changes with exertion, there is a need to modify their clothing to avoid becoming overheated. Thus, it would be useful to have an adjustable article of clothing which might also serve as a small carrying bag for a number of personal items.

SUMMARY AND OBJECTS OF THE INVENTION

It is an object of the present invention to provide a combination hat and bag which is both attractive to wear and relatively easy and inexpensive to make.

Another object is to provide a hat/bag combination particularly suitable for cold weather use.

The hat/bag combination of this invention is a substantially tubular article having a first closed end and forming an opening at an opposing second end. A drawstring is attached to the tubular body portion at the second end for adjusting the size of the opening. The article forms a hat with the tubular body portion forming an adjustable crown and the opening forming an adjustable rim. Alternatively, the article functions as a bag with the tubular body portion forming a carrying compartment and the drawstring forming a handle and a means for opening and closing the bag.

In a preferred embodiment, the tubular article is formed from sewn strips of a flexible sheet material such as pile fleece. This material is: water repellant and yet breathable; lightweight and yet can be made warmer than wool; soft and compressible for comfort and minimum carrying space, but also moldable as a hat material to provide a variety of attractive hat styles. When not worn as a hat, the fleece bag can be used to carry gloves or other personal articles, and the drawstring handle can be used to attach the bag to the wearer's belt loop or wrist and otherwise minimize the inconvenience of carrying an additional article.

Other objects and advantages of the present invention will become more apparent from the following detailed description taken in combination with the accompanying drawings.

DETAILED DESCRIPTION

Figure 5:
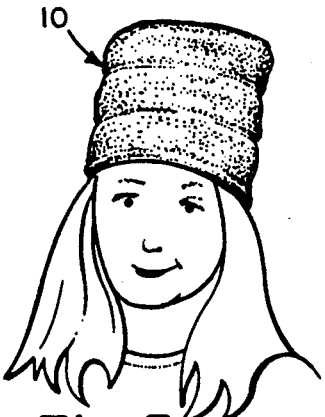
FIG. 5 is a perspective view of the article worn as a hat, and the tubular member styled as a straight crown.
Figure 6:
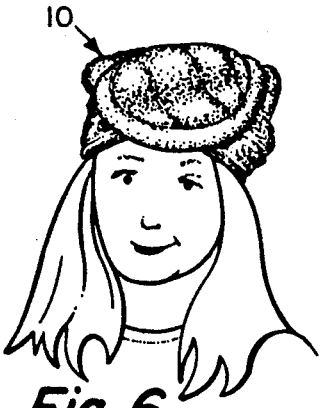
FIG. 6 is a perspective view of the article worn as a hat, in an alternative style with the tubular member pushed down in front as a beret.
Figure 7:
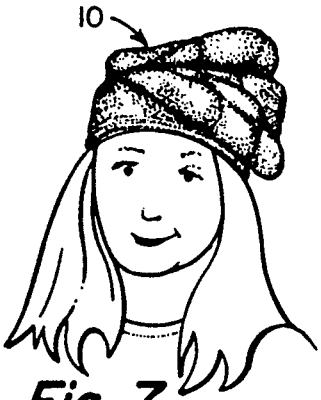
FIG. 7 is a perspective view of the article worn as a hat, in an alternative style with the tubular member pushed down to one side.
Figure 1:
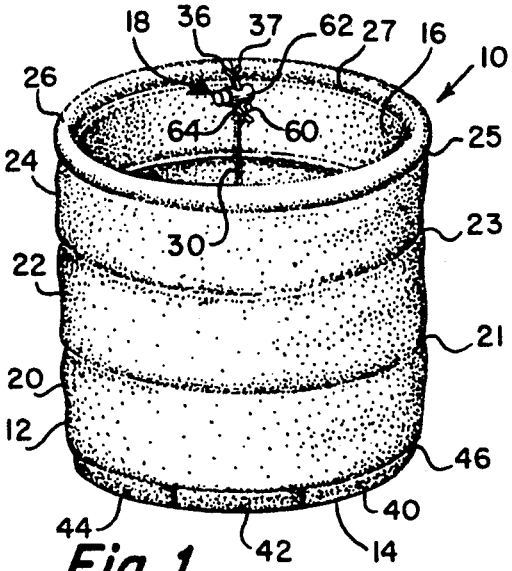
FIG. 1 is a perspective view of the combination hat/-bag article, with the drawstring end open.
Figure 4:
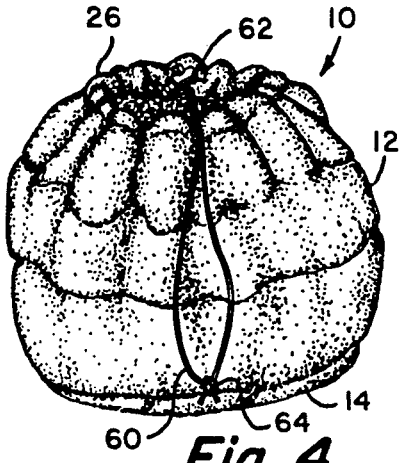
FIG. 4 is a perspective view of the article when used as a bag, showing the drawstring in the closed position.
Figure 2:
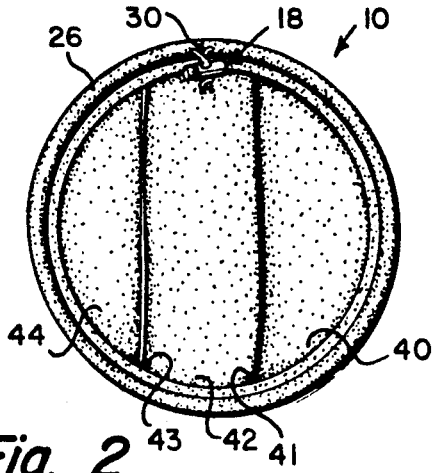
FIG. 2 is a bottom plan view looking into the open drawstring end of the article.
Figure 3:
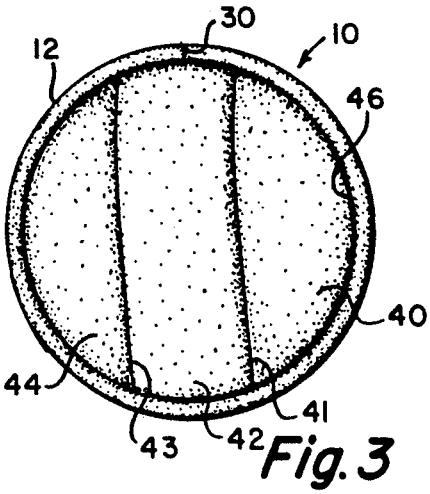
FIG. 3 is a top plan view looking at the closed end of the article.

A preferred embodiment of this invention is shown in the drawings as a combination hat/bag article 10. FIGS. 1–3 show side, bottom and top views of the article with the drawstring fully open at one end. FIG. 4 shows the article with the drawstring contracted to form a closed bag. FIGS. 5–7 show the article as a hat worn on the user's head, and illustrate the ability to adjustably style the hat. Finally FIGS. 8–13 illustrate the steps of making the preferred article.

As shown in FIGS. 1–4, the hat/bag article 10 includes a sidewall 12 forming a tubular body portion, a closed top or first end 14, and an opening formed at the opposing second or bottom end 16. A drawstring 18 is provided adjacent the bottom end 16 for adjusting the size of the opening.

The sidewall 12 includes four elongated strips attached along their "long" sides as follows. A top sidewall strip 20 is provided adjacent the closed end 14, and is sewn to mid sidewall strip 22 by seam 21 A lower sidewall strip 24 is sewn to mid-sidewall strip 22 at seam 23. A hem sidewall strip 26 is sewn to lower sidewall strip 24 at seam 25. The hem strip 26 is folded inwardly and the edge sewn at seam 27 to provide a central drawstring passage 28 at the lower end of the sidewall. The remaining "short" edges of the strips are sewn together by a vertical sidewall seam 30. Two holes 36 and 37 are provided in hem 26 adjacent seam 30 to which opposing ends of the drawstring 18 exit the drawstring passage 28. The drawstring includes an elastic cord 60, a lock 62 having a bore through which the two ends of cord 60 pass and are adjustably and releasably engaged, and a knot 54 provided at the free ends of the drawstring for retaining the sliding locking member on the cord 60.

The closed end 14 of the article includes three elongated strips sewn together to form a substantially circular top wall and which is sewn about its circumference to one end of the tubular body portion 12. Thus, closed top wall 14 includes a right top strip 40 and a middle top strip 42 sewn together by seam 41. A left top strip 42 is sewn to middle top strip 42 by seam 43. The substantially circular circumference of the attached strips is sewn to the tubular body portion 12 at one end by seam 46.

The article is shown as a drawstring bag in FIG. 4 and as an adjustably stylized hat in FIGS. 5–7. The article is preferably made of strips of synthetic polyester pile fleece, which is available in various weights or thicknesses. Thus, a double pile is substantially thicker and thus warmer than a single pile. This material is water repellent and yet lightweight and breathable. Depending on the thickness it can be warmer than wool, but still breath to prevent body moisture from accumulating under the hat. The pile fleece is soft and comfortable to wear, and is generally non-irritating to the skin. It is soft and compressible and thus will occupy a minimum of space if rolled up for storage. However, it has sufficient stiffness or "body" when provided in sewn strip form as shown to mold the hat into various styles. For example, the hat can be worn straight up as shown in FIG. 5 like a top hat. Alternatively, it can be pushed down to form a beret or various other shapes. It can be worn straight up with the top end pushed in and rounded to form a cossack type hat, or the lower edge can be folded or rolled up outside to form various styles. This is particularly attractive to young adults and skiers who want to provide either an outlandish or particularly unique style.

The article can be provided in a variety of attractive combinations of colors and patterns. Pile fleece is widely used in the clothing industry in a variety of colors and patterns. Also, because this article utilizes relatively narrow strips of the pile fleece, it is possible to form the hat from "end or remnant pieces" which are discarded or sold at very reasonable cost by clothing manufacturers. A preferred method of making the article is shown in FIGS. 8–13 and described below.

Figure 8:
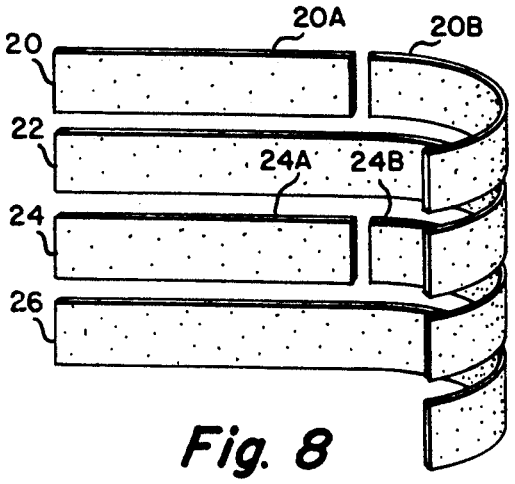
FIG. 8 shows a first step in preparing the article, wherein a plurality of sidewall strips are provided.

In a first step shown in FIG. 8, a plurality of elongated sidewall strips 20, 22, 24 and 26 as previously described are provided with their long edges aligned. Where necessary or desirable, some of the strips may include a plurality of pieces such as top sidewall strip 20 including pieces 20A and 20B, and lower sidewall strip 24 including pieces 24A and 24B.

Figure 9:
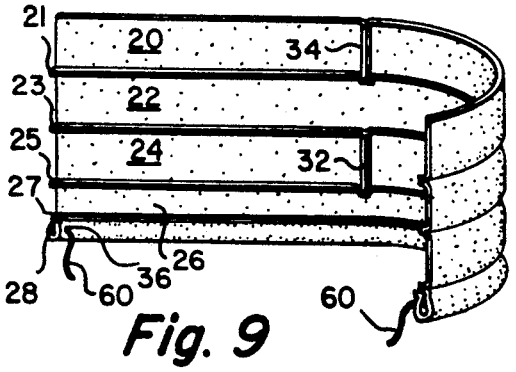
FIG. 9 shows a second step in preparing the article, wherein the sidewall strips are sewn together and a lower hem provided for the drawstring.

In a second step shown in FIG. 9, the long edges are sewn together as previously described by horizontal seams 21, 23 and 25, and the hem strip 26 is folded back and sewn at seam 27 to provide a central drawstring passage 28. Drawstring 60 may be placed within the folded edge prior to sewing seam 27, or else may be pulled through passage 28 via holes 36 and 37 from which the opposing ends of the cord 60 exit. The sidewall pieces 20A and 20B are attached by vertical seam 34 and pieces 24A and 24B by vertical seam 32.

Figure 10:
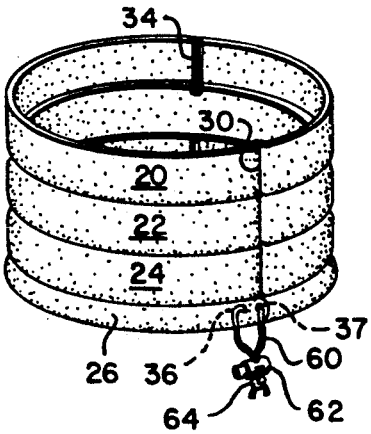
FIG. 10 shows a third step in preparing the article, wherein a vertical sidewall seam is formed to provide a tubular body portion.

In a third step shown in FIG. 10, the attached sidewall pieces are formed into a tubular article by vertical sidewall seam 30.

Figure 11:
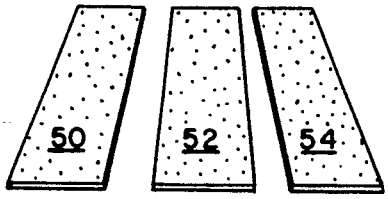
FIG. 11 shows a fourth step in preparing the article, wherein a plurality of strips are provided for forming the closed end of the article.

In a fourth step shown in FIG. 11, three rectangular strips 50, 52 and 54 are provided and aligned along their long edges in order to prepare the closed end 14.

Figure 12:
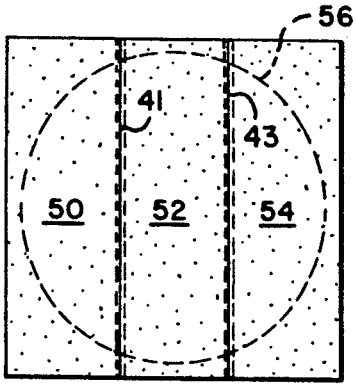
FIG. 12 shows a fifth step in preparing the article, wherein the closed end strips are sewn together and a circular end piece cut therefrom.

In a fifth step shown in FIG. 12, the left and middle pieces 50 and 52 are attached at seam 51 and the middle and right pieces 52 and 54 are attached at seam 53. Then, a substantially circular end wall is cut from the attached strips as shown by the dashed circle 56 to form the closed end wall 14.

Figure 13:
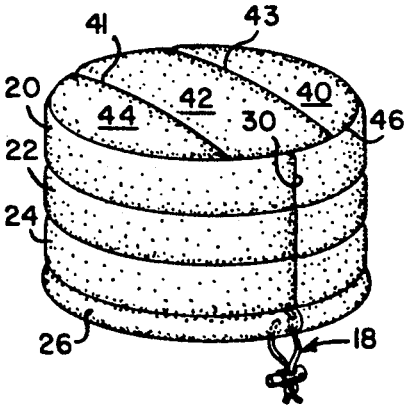
FIG. 13 shows a sixth step in preparing the article, wherein the circular end piece is sewn to the tubular body portion to form the finished article.

In a sixth step shown in FIG. 13, the substantially circular end piece 14 is attached to the first end of the tubular sidewall at seam 46 to form the finished article.

The previously described six-step method may utilize relatively low-cost pile fleece remnant pieces. Similarly, the process itself requires relatively little equipment (scissors and sewing machine), and is substantially easy and quick. This enables the article to be made at a relatively low cost, while still providing a very versatile and attractive combination article. It is understood that the method steps can be modified in terms of the order of steps, the number of strips, the relative sizes and shapes of the sidewall and closed end, without departing from the invention. Generally, the article is most useful when provided with a sidewall height of from about 6 to 12 inches, a sidewall circumference of from about 20 to 24 inches, and a sidewall diameter of from about 6 to 8 inches.

As further examples of alternative embodiments, all of the horizontal strips forming the tubular body may be continuous (like strips 22 and 26), as opposed to the separate pieces of strips 20A, 20B and 24A and 24B. Also, the top piece 14 may be a single piece, rather than a sewn strip. A double hem may be provided wherein the first hem (formed by seam 27) is folded up inside and attached to strip 24, thereby covering seam 25, and the second hem forms the channel for the drawstring with two holes cut at opposing ends for the drawstring ends to exit. Still further, materials other than pile fleece may be used, such as woven or knit textiles. The tubular body portion of the article can be extended to provide a taller hat (and deeper bag) and the article can also function as a pillow or pillowcase for campers.

Although certain preferred embodiments of the invention have been specifically illustrated and described herein, it is to be understood that variations may be made without departing from the spirit and scope of the invention as defined by the appended claims. Thus, all variations are to be considered as part of the invention as defined by the following claims.

What is claimed is:

1. A hat/bag combination article comprising:

a tubular member having a body portion with a first closed end and an opening at an opposing second end, the body portion including a tubular sidewall formed from a plurality of elongated strips of pile fleece attached along their long edges, and the body portion further including a top wall attached to one end of the tubular sidewall and forming the first closed end, a drawstring attached to the tubular sidewall at the second end for adjusting the size of the opening, wherein the member functions as a hat with the body portion forming an adjustable crown and with sufficient body or stiffness for the tubular sidewall to be worn straight up or pushed down into a variety of styles, and the opening forming an adjustable rim, and the member also functions as a bag with the body portion forming a carrying compartment and the drawstring forming a handle and means of opening and closing the bag.

2. The combination of claim 1, wherein the pile fleece is made of polyester.

3. The combination of claim 2, wherein the the short edges of the sidewall strips are attached to form a vertical sideseam.

4. The combination of claim 1, wherein the sidewall has a height of from about 6 to about 12 inches, a sidewall circumference of from about 20 to about 24 inches, and a sidewall diameter of from about 6 to about 8 inches.

5. The combination of claim 1, wherein the top wall is also formed of attached strips of pile fleece.

6. The combination of claim 1, wherein the attached sidewall strips are sewn together.

7. The combination of claim 1, wherein the drawstring is an elastic cord with a slidable lock.

8. The combination of claim 1, wherein the body portion includes a folded hem forming a passage for the drawstring.

9. The combination of claim 1, wherein the sidewall strips comprise horizontal strips.

10. The combination of claim 1, wherein the sidewall strips include elongated strips formed from a plurality of strips attached at their short edges.

* * * * *